US006763762B2

(12) United States Patent
Blatz

(10) Patent No.: US 6,763,762 B2
(45) Date of Patent: Jul. 20, 2004

(54) DEVICE FOR GATHERING AND COMPACTING PAPER TOWELS

(76) Inventor: Wilhelm Blatz, Schweizergasse 7, 63486, Bruchköbel (DE)

( * ) Notice: Subject to any disclaimer, the term of this patent is extended or adjusted under 35 U.S.C. 154(b) by 0 days.

(21) Appl. No.: 10/257,940

(22) PCT Filed: May 8, 2001

(86) PCT No.: PCT/EP01/05210

§ 371 (c)(1),
(2), (4) Date: Oct. 22, 2002

(87) PCT Pub. No.: WO01/85576

PCT Pub. Date: Nov. 15, 2001

(65) Prior Publication Data

US 2003/0121425 A1 Jul. 3, 2003

(30) Foreign Application Priority Data

May 8, 2000 (DE) ..... 200 08 088 U

(51) Int. Cl.[7] ..... B30B 1/24
(52) U.S. Cl. ..... 100/229 A; 100/233; 100/250
(58) Field of Search ..... 100/229 A, 233, 100/215, 250, 274, 295, 255, 262; 53/525; 141/73, 80; 220/908

(56) References Cited

U.S. PATENT DOCUMENTS 434,128 A * 8/1890 Gamien ..... 100/116
2,478,815 A * 8/1949 Forman ..... 100/102
3,691,944 A * 9/1972 Boyd ..... 100/229 A
3,882,770 A * 5/1975 Bleasdale ..... 100/49
3,893,386 A * 7/1975 Wise ..... 100/50
4,519,308 A 5/1985 Eberle ..... 100/102
5,588,358 A * 12/1996 Klepacki et al. ..... 100/349

FOREIGN PATENT DOCUMENTS

DE 88 09 884.2 U 11/1988
EP 438978 7/1991

* cited by examiner

*Primary Examiner*—Allen Ostrager
*Assistant Examiner*—Jimmy T Nguyen
(74) *Attorney, Agent, or Firm*—Dennison, Schultz, Dougherty & MacDonald

(57) ABSTRACT

A device for gathering and compacting compactible goods such as paper towels, includes a housing provided with an opening for supplying the goods, with a holder for acccomodating the compactible goods and a compacting element that is pivotable about an arbor and which extends above the holder. The goods between the holder bottom and the compacting element are compactible by means of the compacting element. A drive extends from the compacting element which, to pivot the compacting element, and meshes with a denticulated element that curves about the arbor, serving as a center of curvature.

14 Claims, 3 Drawing Sheets

DEVICE FOR GATHERING AND COMPACTING PAPER TOWELS

BACKGROUND OF THE INVENTION

The invention relates to a device for gathering and compacting compactible goods such as paper towels, comprising a housing having a opening provided for supplying the goods, with a holder for holding the compactible goods and with a compacting element extending above the holder and pivoting about an arbor, by means of which the goods can be compacted between the holder bottom and the compacting element.

A corresponding device can be found in DE 31 22 355 A1. In order to gather and compact paper towels, a stack-like container provided with an opening is provided in which a base can be shifted against the action of an accumulator. A compacting device is provided in the area of the feed opening, said compacting device consisting of a valve which is fastened to a swivel axis and which can be turned together with it from an approximately vertical starting position into a horizontal operating position. This makes it possible to compress paper towels. The disadvantage of this corresponding device is that a manual operation takes place, in addition to which it is found that this often occurs with hands that are still wet, so that hygienic concerns arise.

SUMMARY OF THE INVENTION

The object of the present invention is to further develop a device of the aforementioned type in such a way that a problem-free compacting of compactible goods, in particular paper towels, is possible using constructively simple measures, without the basic need for a manual operation. A high degree of reliability should be given and it should be possible to generate compressive forces to the required extent.

According to the invention, the problem is essentially solved thereby that a drive with a gearing exits the compacting element which, to pivot the compacting element, meshes with a denticulated element that curves about the arbor serving as a centre of curvature.

Contrary to the previously known prior art, a plate-like compacting element, such as a plate piston, is used which itself comprises those elements which are required for the pivoting, so that, even with a light construction of the compacting element, the necessary mass is provided due to the integrated drive and, optionally, further control elements, such as perhaps a transformer, in order to be able to compact the compactible goods such as paper towels to the required extent. In this case, it is provided that the drive, such as an electric motor, and the gearing proceed from a surface of the compacting element that extends on the end with the opening.

The gearing comprises at least two gear wheels, one of which meshes with the denticulated element, such as a curved rack.

In order to be able to purposely deliver the goods to be compacted into the housing and thus in direction of the holder, it is furthermore provided that a deflector bar supplying the goods to be compacted to an area in the housing extends within the opening, said area extending opposite the arbor. The latter extends in a first peripheral area of the compacting element, a cover element which covers the compacting element on the open end proceeding from the peripheral area of the compacting element that is remote from the arbor, said cover element extending at least to the deflector bar, independent of the position of the compacting element.

The cover element itself is, in particular, a curved lamellar element such as a sheet metal element which is connected with the peripheral area of the sealing element that is remote from the arbor and curved in such a way that the cover element extends along the deflector bar to the arbor when the compacting element is in a horizontal position or extends essentially horizontally and extends in a guide on the arbor end, said guide extending along the inner surface of the housing on the arbor end, namely between the inner surface and the arbor.

The peripheral area of the compacting element remote from the arbor and the guide for the cover element itself extend parallel to one another and parallel to the arbor.

The holder to hold the goods to be compacted should be a paper bag or lined with a paper bag, so that the goods to be compacted together with the paper bag can be removed from the device and disposed of as a unit.

The compacting element is preferably trapezoidal in cross section, its side surfaces exhibiting a curved shape. The shorter base surface thereby extends on the holder end.

The cover element extends in such a way that, when the compacting element is horizontal or extends essentially horizontally, the cover ends directly in the area of the arbor. Furthermore, the deflector bar should be adapted in its geometry to the shape of the cover on the cover end, so that it is assured that goods to be compacted cannot reach between the cover and deflector bar.

Furthermore, a sensor, e.g. a light barrier, can be provided to monitor the fill level of the goods supplied to the holder, so that the goods are automatically compacted after reaching a preset fill level in the holder.

Further details, advantages and features of the invention can be found not only in the claims, the features to be derived therefrom—alone or in combination—but also in the following description of the preferred embodiments to be found in the drawings.

DESCRIPTION OF THE PREFERRED EMBODIMENTS

Figure 1:
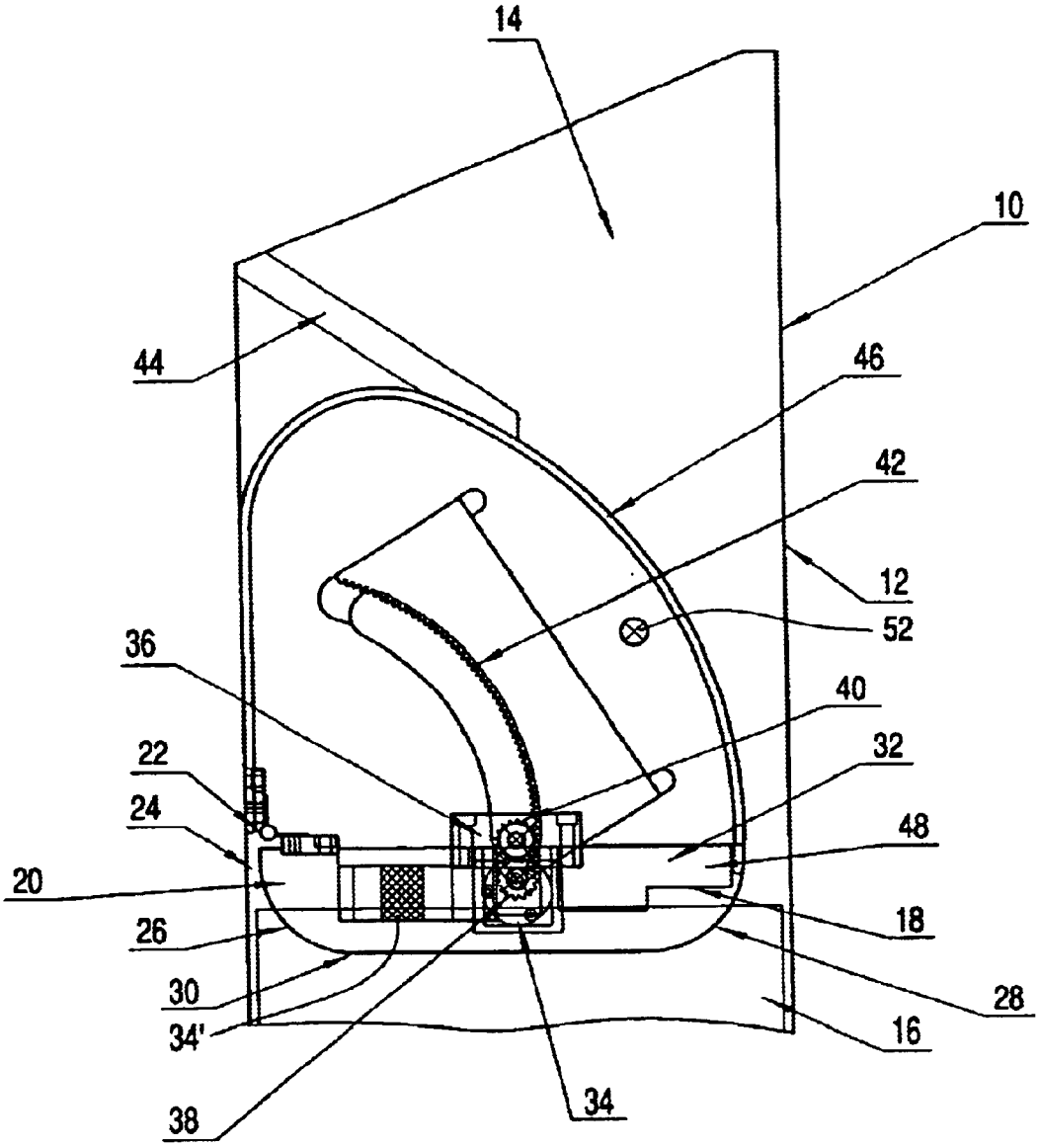
FIG. 1 an area on the end with the opening of a device for compacting goods, FIG. 2 a representation corresponding to FIG. 1 with various positions of a compacting element and FIG. 3 a block diagram.
Figure 2:
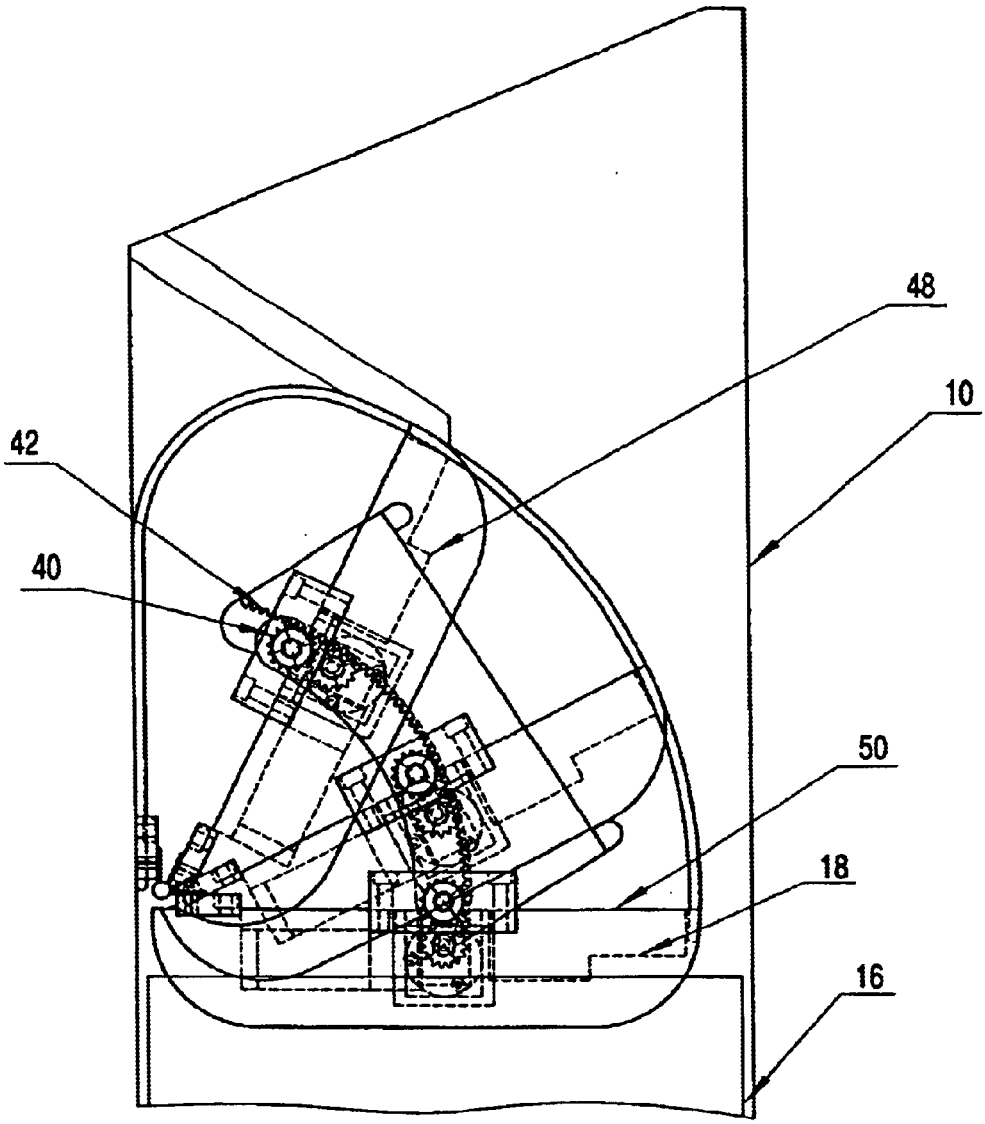

A device 10 or compacting compactible goods, e.g. in particular paper towels, is shown in a sectional view and in detail in FIGS. 1 and 2. The device 10 comprises a housing 12 with an opening 14 via which the goods can be supplied. On the bottom end, the housing 12 has a holder, such as a compacting basket 16, which is lined with a bag, e.g. a paper bag, consisting in particular of a recyclable material, in order to be able to remove and dispose of goods compacted by means of the device 10 together with the bag as a unit.

To compact the goods supplied to the housing 12, a compacting element 18, to be designated as a plate piston, is provided which is pivotable about an arbor 22 in the area of an edge 20, said arbor in turn extending along an inner wall surface 24 of the housing 12. As can be seen in the sectional views of FIGS. 1 and 2, the plate piston 18 has a trapezoidal geometry in cross section, the side surfaces 26, 28 of which extend in a curved manner, and the shorter bottom surface 30 of which extends at the holder end. At the top, i.e. in the area 32 on the end with the opening, a drive in the form of an electromotor 34 with a gearing 36 proceeding therefrom is provided in the plate piston 18, said gear 36 should comprise at least two gear wheels 38, 40, of which the gear wheel 40 not directly connected with the output drive shaft for its part meshes with a curved rack 42 which is curved about the arbor 22 serving as a centre of curvature. This results in the advantage that, when the electromotor 34 is actuated and the gear wheel 40 meshes with the rack 42, the plate piston 32 is pivoted, so that goods present in the compacting basket 16 can be compacted. Thus, the rack 42 follows a circular segment with the arbor 22 as centre point.

The rack 42 itself can thereby be situated on an inner surface of the housing 12 extending at a right angle to the wall 24.

As can be seen in FIGS. 1 and 2, a deflector bar 44 proceeds from the inside wall 24 of the housing 12, said deflector bar 44 ensuring that the goods reaching the housing 12 and thus the compacting basket 16 via the opening 14 are supplied to the area which is remote from the arbor. Thus, it is assured that goods cannot reach between the plate piston 18 and the inside wall 24 when the plate piston 18 is raised, i.e. accessible holder 16. In addition, a cover 46 is provided which extends from the peripheral area 48 of the piston 18 remote from the arbor to the underside of the deflector bar 44 and then along the inside wall 24 of the housing 12. Accordingly, when the plate piston 18 is horizontal or essentially horizontal, the cover element 46 has the geometry of a semi-ellipse or almost semi-ellipse in cross section. The cover element 46 thereby extends in the area of the inner wall 24 along a guide.

Furthermore, the deflector bar 44 has a geometry adapted to the shape of the cover element 46 on the end with the cover element, so that no gap can form between the deflector bar 44 and the cover element 46, into which any goods that might have come to adhere to the cover element 46 can reach when the plate piston 18 and thus the cover element 46 are adjusted.

Various positons of the plate piston 18 can be seen in FIG. 2. It can be seen that, when the gear wheel 40 meshes with the rack 42, he desired pivoting of the plate piston 18 takes place without the need for any additional features. Furthermore, due to the fact that the drive 34, including control and optionally required transformer 34', are integrated in the late piston 18, the advantage results that a sufficient weigh is given in order to be able to compact the goods, e.g. paper towels, to the required extent, even with a relatively light construction of the plate piston 18.

Figure 3:
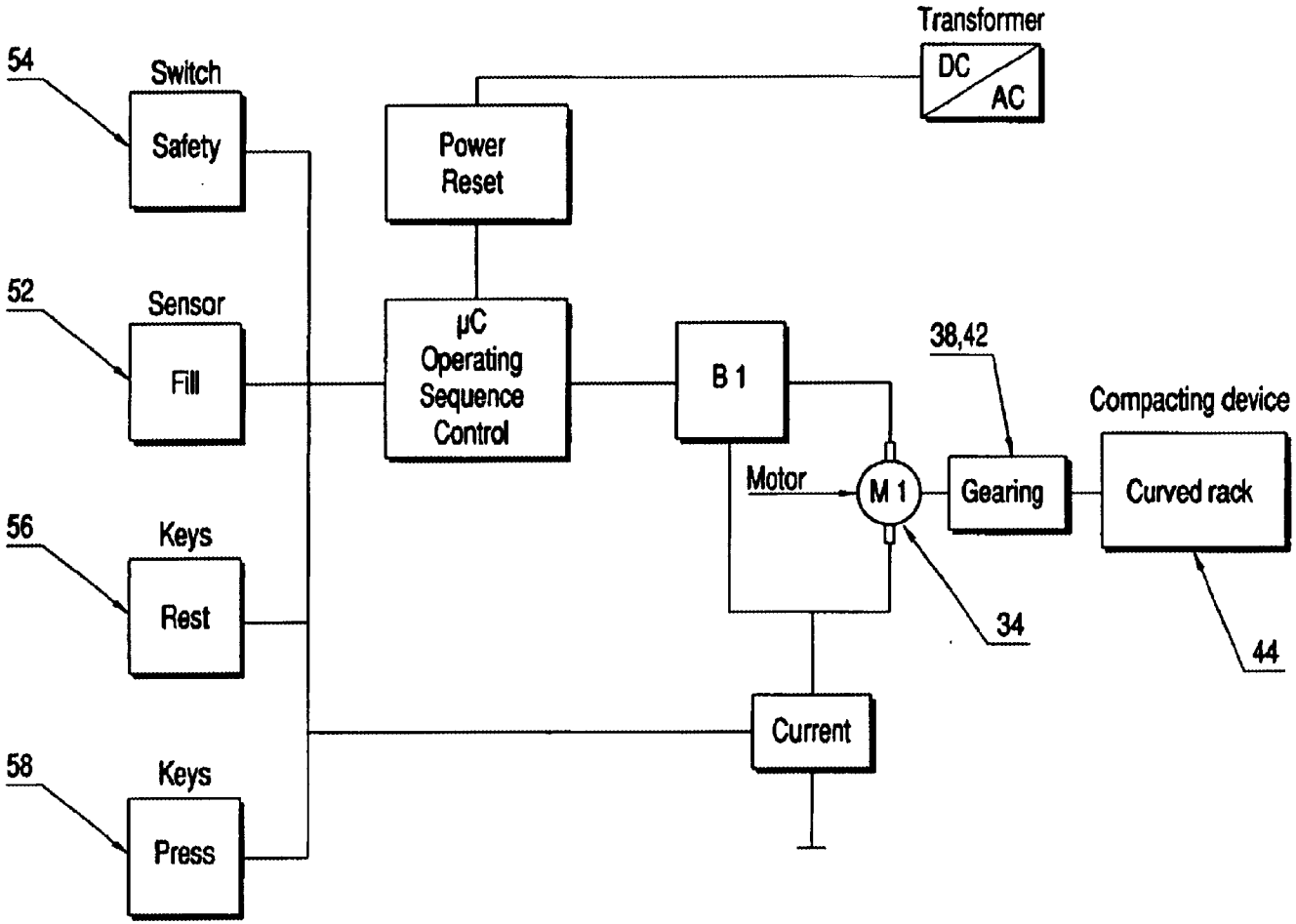

A block diagram for the device according to the invention for compacting goods, in particular paper towels, in order to be able to compact them to a small volume, can be seen in FIG. 3.

The control mechanism is microprocessor-controlled, whereby a sensor 52 can also be provided to monitor the fill level of the holder 16, as a result of which the plate piston 18 is turned from its raised position (position 48 in FIG. 2) found in the area of the deflector bar 14 into its horizontal position (position 50 in FIG. 2) by meshing of the gear wheel 40 with the curved rack 42. Furthermore, a safety switch 54 is provided. Keys 56, 58 can also be provided to start it or turn it off.

What is claimed is:

1. Device for gathering and compacting compactible goods, comprising:

a housing having an upper end and a bottom end, said upper end comprising an opening for receiving said compactible goods;

a holder for accommodating said compactible goods and disposed at said bottom end;

a compacting element pivotably mounted about an arbor and extending above said holder;

a drive mechanism mounted on or in said compacting element;

a denticulated element mounted onto the housing and having a curvature having a center superimposed on said arbor;

said drive mechanism meshes with said denticulated element to pivot said compacting element to compact said compactible goods between said bottom end and said compacting element.

2. Device according to claim 1, wherein the compacting element (18) is a plate-like piston, a drive (34), and a gearing (36) proceeding from an area (32) on said bottom end of said housing.

3. Device according to claim 1, wherein the drive mechanism comprises at least two gear wheels (38,40), one of which meshes with the denticulated element (42).

4. Device according to claim 1, further comprising a deflector bar (44) attached to a inner wall (24) of the housing (12) and extending therefrom within the opening for guiding the goods in the housing to an area.

5. Device according to claim 1, wherein the arbor (22) extends in a first peripheral area (20) of the compacting element (18).

6. Device according to claim 1, further comprising a cover element (46) covering the compacting element on said bottom end of the housing and proceeds from a peripheral area (48) of the compacting element (18) that is remote from the arbor, said cover element (46) extending at least to a deflector bar (44) independent of a position of the compacting element.

7. Device according to claim 1, further comprising a cover element (46) that is a curved formed element and attached to a peripheral area (48) of the compacting element {18) remote from the arbor and curved in such a way that it extends along a deflector bar (44) to the arbor (22) independent of a position of the compacting element, and extends in a guide on the arbor end which extends along an inner surface (24) of the housing (12) on the arbor end.

8. Device according to claim 1, wherein the peripheral area (48) of the compacting element (18) remote from the arbor and a guide for a cover element extends parallel to one another and parallel to the arbor (22).

9. Device according to claim 1, wherein the holder (16) accommodating the goods to be compacted is lined with a bag.

10. Device according to claim 1, wherein the compacting element (18) is trapezoidal in cross section and has curved side surfaces (26, 28).

11. Device according to claim 1, further comprising a cover element (46) attached to a peripheral area of the compacting element wherein the cover element ends directly in an area of the arbor (22) when the compacting element (18) is horizontal or essentially horizontal relative to said bottom end of said housing.

12. Device according to claim 11, further comprising a deflector bar (44) adapted and configured to the shape of the cover element (46) at one end thereof.

13. Device according to claim 1, further comprising electrical control mechanisms required for the device (10), including a transformer, are located in or on the compacting element (18).

14. Device according to claim 1, further comprising a sensor is provided for monitoring the fill level of the goods supplied to the holder (16).

* * * * *